US008876632B2

(12) United States Patent
Deshmukh et al.

(10) Patent No.: US 8,876,632 B2
(45) Date of Patent: Nov. 4, 2014

(54) MULTI-PIECE GOLF CLUB HEADS FORMED FROM TITANIUM AND ZIRCONIUM ALLOYS

(75) Inventors: Uday Deshmukh, Carlsbad, CA (US); Thomas O. Bennett, Carlsbad, CA (US); Charles E. Golden, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 51 days.

(21) Appl. No.: 13/615,816

(22) Filed: Sep. 14, 2012

(65) Prior Publication Data

US 2014/0080632 A1 Mar. 20, 2014

(51) Int. Cl.
*A63B 53/04* (2006.01)

(52) U.S. Cl.
USPC ..... 473/342; 473/345

(58) Field of Classification Search
USPC ..... 473/342
See application file for complete search history.

(56) References Cited

U.S. PATENT DOCUMENTS

| | | | | |
|---|---|---|---|---|
| 6,017,280 | A * | 1/2000 | Hubert | 473/324 |
| 7,628,713 | B2 * | 12/2009 | Tavares | 473/345 |
| 2004/0229713 | A1 * | 11/2004 | Helmstetter et al. | 473/342 |
| 2009/0124411 | A1 * | 5/2009 | Rae et al. | 473/345 |
| 2010/0261540 | A1 * | 10/2010 | Roach | 473/291 |
| 2012/0004048 | A1 * | 1/2012 | De La Cruz et al. | 473/342 |

* cited by examiner

*Primary Examiner* — Michael Dennis
(74) *Attorney, Agent, or Firm* — Smith, Gambrell & Russell, LLP

(57) ABSTRACT

A golf club head and a method for forming a golf club head are disclosed. The golf club head may include multiple components with varying densities to manipulate the weight, volume, and properties of the golf club head.

6 Claims, 4 Drawing Sheets

MULTI-PIECE GOLF CLUB HEADS FORMED FROM TITANIUM AND ZIRCONIUM ALLOYS

FIELD OF THE INVENTION

The present invention relates to a golf club head comprising materials designed to provide specific densities for use in various parts of the club head to achieve maximum volume within specific weight goals. More specifically, the present invention relates to a golf club head with properties that may be manipulated based on the low and high density materials.

BACKGROUND OF THE INVENTION

Various design parameters affect the performance of a wood-type golf club (e.g., drivers, fairway woods, and hybrids). Accordingly, golf equipment designers are constantly manipulating the shape, size, and materials used to manufacture clubs and balls.

For example, as golf club heads have increased in volume, their moments of inertia have also increased. Indeed, a larger moment of inertia, which is the resistance to twisting of any golf club head when the golf ball is impacted off center, provides what manufacturers refer to a "larger sweet spot" and results in more forgiveness on off-center hits. However, when the volume of a golf club head is maximized through spatially distributing the mass in all three orthogonal orientations, the center of gravity of the golf club head is positioned substantially rearward from the front face of the golf club head, which renders shots struck off-center from the sweet spot of the golf club head undesirable as a result of the side-spin or backspin.

In some instances, one or more weight members attached to the golf club head may be positioned to manipulate the center of gravity. Alternately, manufacturers have attempted to manipulate the distribution of the amount of material in various parts of the head to strike a balance between the moment of inertia and center of gravity. Adding weight to certain areas of a golf club head, however, may cause it to become heavy and unwieldy, possibly to the point of limiting a golfer's swing speed and adversely affecting the golfer's swing mechanics. Similarly, manipulating the distribution of material may result in a club head that cannot withstand the stress of repeated impacts with a golf ball that occur during normal use of the resulting golf club.

Designers have also attempted to manipulate the weight distribution of the club head using low and high density materials, although low density materials are typically only been placed in non-critical areas or low impact areas. In addition, attempts to manipulate the weight distribution of the club head using low and high density materials are somewhat limited by the process, e.g., the thickness/thinness of the casting. For example, a widely used material for wood-type golf club heads is titanium alloy. The alloy is available for casting and in wrought sheet form, but because the mechanical properties of the cast material are inferior to the wrought material, the thickness of the cast material must be greater than the wrought material for maximum performance. Accordingly, the weight reduction in non-critical areas of the club head is limited to the thickness/thinness that can be achieved with the specific material used and the casting process rather than the mechanical properties of the alloy material.

With regard to fairway woods, which have a smaller profile than drivers but larger profile than hybrids, if conventional titanium alloys are used to make the fairway wood golf club head, the low density of the material requires additional weights to be added to meet the required mass. Thus, most manufacturers use stainless steel for the body and titanium for the face. However, this is not ideal because the combination of materials yields two discrete densities and limits the design options.

Therefore, there is a continuing need for wood-type golf club heads (and methods of manufacturing such heads) that have high strength faces and bodies made from metal alloys with densities that can be tailored depending on the shape, size, and performance requirements of the particular club head. Accordingly, the present invention provides a method of making a golf club head (and the resulting golf club head) that includes multiple materials to achieve the proper balance between mass distribution and club head performance.

SUMMARY OF THE INVENTION

The present invention is directed to a golf club head, including: a first portion including a body defining an inner volume, sole, and a skirt, wherein the first portion is formed from a first titanium alloy having a first density ranging from about 4 g/cm$^3$ to about 5 g/cm$^3$; a second portion including a crown, wherein the second portion is formed from a second titanium alloy having a second density ranging from about 4 g/cm$^3$ to about 5 g/cm$^3$; and a third portion including a face, wherein the third portion is formed from a third titanium alloy having a third density ranging from about 4 g/cm$^3$ to about 5 g/cm$^3$.

In one embodiment, the second density is different from the first density. In another embodiment, the third density is greater than the first and second densities. The first titanium alloy may include Ti-8Al-1V-1Mo. In still another embodiment, the second titanium alloy includes Ti-5Al-1Fe-1Cr-0.7Mo.

The golf club head may include at least one weight and/or at least one corresponding weight port. In one embodiment, the volume of the club head volume is between about 300 cc and about 460 cc.

The present invention is also related to a golf club head, including: a first portion including a body defining an inner volume, a sole, a crown, and a skirt, wherein the first portion includes a first material having a first density and a first weight, wherein the first material includes an alloy including titanium, zirconium, or a combination thereof, and wherein the first density ranges from about 7 g/cm$^3$ to about 8.5 g/cm$^3$; and a second portion including a face, wherein the second portion includes a second material having a second density less than the first density, wherein the second density is at least about 30 percent less than the first density.

In one embodiment, the first material includes a binary titanium-zirconium alloy. In another embodiment, the binary titanium-zirconium alloy includes about 25 percent to about 75 percent by weight Zr. In still another embodiment, the binary titanium-zirconium alloy includes about 10 percent to about 19 percent by weight Zr. The second density may range from about 4 g/cm$^3$ to about 5.5 g/cm$^3$.

BRIEF DESCRIPTION OF THE DRAWINGS

Further features and advantages of the invention can be ascertained from the following detailed description that is provided in connection with the drawings described below.

DETAILED DESCRIPTION OF THE PREFERRED EMBODIMENTS

Figure 1:
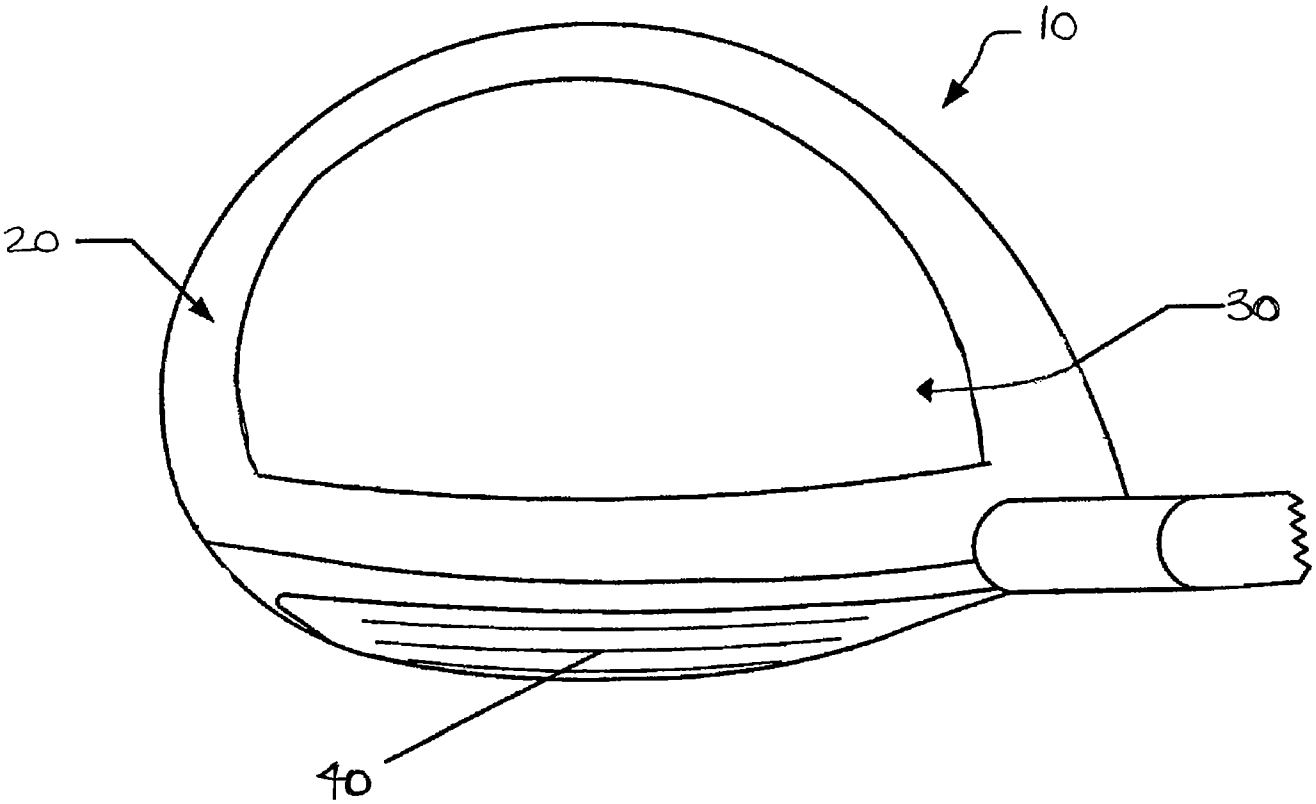
FIG. 1 shows a top view of one embodiment of a golf club head according to the present invention.

The present invention relates to wood-type golf club heads, golf clubs, and the like (such as drivers, fairway woods, hybrids, and/or the like), as well as to methods of making and using such clubs and club heads. The club head body member may take on a variety of different forms, shapes, and/or sizes without departing from this invention and includes, but is not limited to, a club head body member defining an interior chamber, a striking face, a crown portion, and a sole portion.

The club head may be made of a one piece construction or from a multi-piece construction. In a multi-piece construction, the club head body member is made from multiple components that are joined together via welding, brazing, adhesive bonding, or combinations thereof. In one embodiment, a club head body member includes two components that are joined together: (1) a club head body member defining an interior chamber without the striking face or a club head body member without the crown. In another embodiment, the club head body member is formed from a plurality of components including, but not limited to, a face insert, a crown, and a body (which includes the sole and a skirt). The club head body member may include two components, three components, four components, five components, six components, or more than six components.

While the overall weight of the wood-type golf club head of the invention will vary depending on the specific type, i.e., driver, fairway wood, hybrid, the use of the materials described herein and the methods of forming the golf club heads of the invention provide a manufacturer the ability to maximize volume and adjust MOI and COG by strategically distributing the materials in different components of the club head. For example, even though a driver will always be designed to weigh between about 190 g and 205 g, the specific materials used in the golf club head allow the maximum volume and strength with adjustability in the MOI and COG. In fact, the relatively low density of titanium, which is 56 percent that of steel and half that of nickel and copper alloys, translates into twice as much metal volume per weight. In addition, the alloys of the present invention offer useful resistance to significantly larger ranges of chemical environments and temperatures compared to other materials including stainless steels and aluminum-, copper-, and nickel-based alloys.

Low Density Titanium Alloys for a Multi-Component Club Head

In one aspect of the invention, the club head is formed from a plurality of components, each component being formed from a different low density titanium alloy with a resulting reduction in the overall weight of the club head as compared to a club head formed from conventional materials. In one embodiment, the club head is formed from at least three components, each formed with a different low density titanium alloy. In particular, the club head in this aspect of the invention may include three components: a club head body member, a crown, and a face insert. In another embodiment, the club head is formed from at least four components, each formed from a different low density titanium alloy. For example, the club head in this aspect of the invention may include four components: a club head body member, a crown, a sole, and a face insert.

Materials

A number of low density titanium alloys are suitable for forming the various components of the club head body member according to this aspect of the invention. Suitable low density titanium alloys include, but are not limited to, alpha or near-alpha titanium alloys such as Ti-8Al-1V-1Mo, Ti-5Al-1Fe-1Cr-0.7Mo, alpha-beta alloys such as Ti-6Al-4V (Ti-6-4), Ti-4.5Al-3V-2Fe-2Mo (SP-700), and Ti-5Al-1Sn-1Zr-1V-0.8Mo (Ti-5111), and heat treated beta alloys such as Ti-15-3-3-3, Beta C, DAT 51, DAT 55. Other suitable titanium alloys include alpha and near-alpha alloys such as Ti-0.3Mo-0.8Ni, Ti-3Al-2.5V, Ti-3Al-2.5V-Pd, Ti-3Al-2.5V-Ru, Ti-5Al-2.5Sn, Ti-5Al-2.5Sn ELI, Ti-8Al-1Mo-1V, and Ti-6Al-2Sn-4Zr-2Mo-0.1Si, alpha-beta alloys such as Ti-6Al-4V ELI, Ti-6Al-4V-0.1Ru, Ti-6Al-7Nb, Ti-6Al-6V-2Sn, Ti-6Al-2Sn-4Zr-6Mo, Ti-4A-4Mo-2Sn-0.5Si, Ti-6Al-2Sn-2Zr-2Mo-2Cr-0.15Si, and Ti-5Al-4Cr-4Mo-2Sn-2Zr, Ti-4Al-2.5V-1.5Fe, Ti-4Al-2Mo-2V-0.5Fe, Ti-6Al-1.5V-1.5Mo-0.3Fe, Ti-5Al-4V-1Mo-0.5Fe, beta and near-beta alloys such as Ti-10V-2Fe-3Al, Ti-3Al-8V-6Cr-4Zr-4Mo, and Ti-3Al-8V-6Cr-4Zr-4Mo-0.05Pd, Ti-15V-3Cr-3Sn-3Al, Ti-15Mo-5Zr-3Al, Ti-15Mo-3Al, Ti-5Al-5V-5Mo-3Cr, Ti-5.5Al-5Mo-5V-2.2Cr-0.8Fe, and mixtures thereof.

Method of Forming

One method of forming a golf club head according to this aspect of the invention includes a first step of casting a club head body member from a first titanium alloy leaving the crown open. Alternatively, the first step includes casting a club head body member from a first titanium alloy leaving the face open. While the specific embodiment provided below contemplates three components, each formed form a different titanium alloy, one of ordinary skill in the art would appreciate that the present invention extends to embodiments where the club head body member is further separated into multiple components, e.g., a sole, a skirt, and the like, each of which may be formed from different titanium alloys.

The first titanium alloy may have a density ranging from 3.5 g/cm$^3$ to about 5.5 g/cm$^3$. In one embodiment, the density of the first titanium alloy is about 4.0 g/cm$^3$ to about 5.0 g/cm$^3$. According to one aspect of the invention, the first titanium alloy has a density of about 4.2 g/cm$^3$ to about 4.6 g/cm$^3$. For example, the density of the first titanium alloy may be about 4.3 g/cm$^3$ to about 4.4 g/cm$^3$. In one embodiment, the first titanium alloy is Ti-8Al-1V-1Mo.

The thickness of the club head body member may be from about 0.1 mm to about 1.0 mm. In one embodiment, the thickness of the club head body member is about 0.2 mm to about 0.8 mm. In still another embodiment, the thickness of the club head body member is about 0.4 mm to about 0.6 mm. In yet another embodiment, the thickness of the club head body member is about 0.5 mm.

After the club head body member is cast, the remaining portion not left open is cut out. For example, if the crown was left open in the first step, the face is cut out and, in the alternative, if the face was left open, the crown is cut out. The crown is then stamped out from a second titanium alloy. The second titanium alloy has a density different than the first and third titanium alloys used to form the club head body member and the face insert. In one embodiment, the second titanium alloy has a density that is greater than the first titanium alloy. The second titanium alloy may have a density ranging from 3.5 g/cm$^3$ to about 5.5 g/cm$^3$. In one embodiment, the density of the second titanium alloy is about 4.0 g/cm$^3$ to about 5.0 g/cm$^3$. According to one aspect of the invention, the second titanium alloy has a density of about 4.2 g/cm$^3$ to about 4.8 g/cm$^3$. For example, in one embodiment, the second titanium alloy has a density of about 4.5 g/cm$^3$ to about 4.8 g/cm$^3$.

In one embodiment, the second titanium alloy is selected from the group consisting of Ti-5Al-1Fe-1Cr-0.7Mo, Ti-15Mo-5Zr, Ti-15Mo-5Zr-3, Ti-17, Ti-4Al-2.5V-1.5Fe, Ti-5Al-4V-0.6Mo-0.4Fe, Ti-5V-5Mo-5Al-3Cr-0.5Fe, and Ti-5V-5Mo-5Al-1Cr-1Fe-1Zr. In another embodiment, the second titanium alloy is Ti-5Al-1Fe-1Cr-0.7Mo.

The thickness of the crown may be from about 0.1 mm to about 1.0 mm. In one embodiment, the thickness of the crown is about 0.2 mm to about 0.8 mm. In still another embodiment, the thickness of the crown is about 0.4 mm to about 0.6 mm. In yet another embodiment, the thickness of the crown is about 0.5 mm.

The face insert may be formed from a third titanium alloy. The third titanium alloy may have a density ranging from 3.5 g/cm$^3$ to about 5.5 g/cm$^3$. In one embodiment, the density of the third titanium alloy is about 4.0 g/cm$^3$ to about 5.0 g/cm$^3$. According to one aspect of the invention, the third titanium alloy has a density of about 4.2 g/cm$^3$ to about 4.6 g/cm$^3$. In one embodiment, the third titanium alloy has a density greater than the first and second titanium alloys. In another embodiment, the third titanium alloy has a density greater than the density of the first titanium alloy, but less than the density of the second titanium alloy.

In one embodiment, the third titanium alloy is selected from the group consisting of Ti-6-4, SP-700, Ti-5111, and TCX11. In another embodiment, the third titanium alloy is selected from the group consisting of Ti-15-3-3-3, Beta C, DAT 51, and DAT 55. In yet another embodiment, the face insert is formed from two or more components, each component formed from a different titanium alloy selected from the group consisting of Ti-6-4, SP-700, Ti-15-3-3-3, Beta C, DAT 51, and DAT 55.

The crown and face inserts may be joined together with the club head body member (in the respective cavities) via welding, infrared brazing, adhesive bonding, or combinations thereof. In one embodiment, the crown and face inserts are joined to the club head body member via welding. The type of welding used to join each insert to the club head body member may be the same for both inserts or different. As would be appreciated by those of ordinary skill in the art, the type of welding used to join the components together may be any suitable welding that results in a joined product with the least weld material at the joints and heat affected zones. In this aspect, suitable types of welding for use with the present invention include, but are not limited to, laser welding, plasma welding, TIG welding, MIG welding, or combinations thereof. In one embodiment, the type of welding used to join either or both of the crown and face components may be laser welding, plasma welding, or combinations thereof. Without being bound to any specific theory, laser and plasma welding reduces the amount of material added at the joint and result in smaller heat affected zones (as compared to TIG welding).

Figure 2:
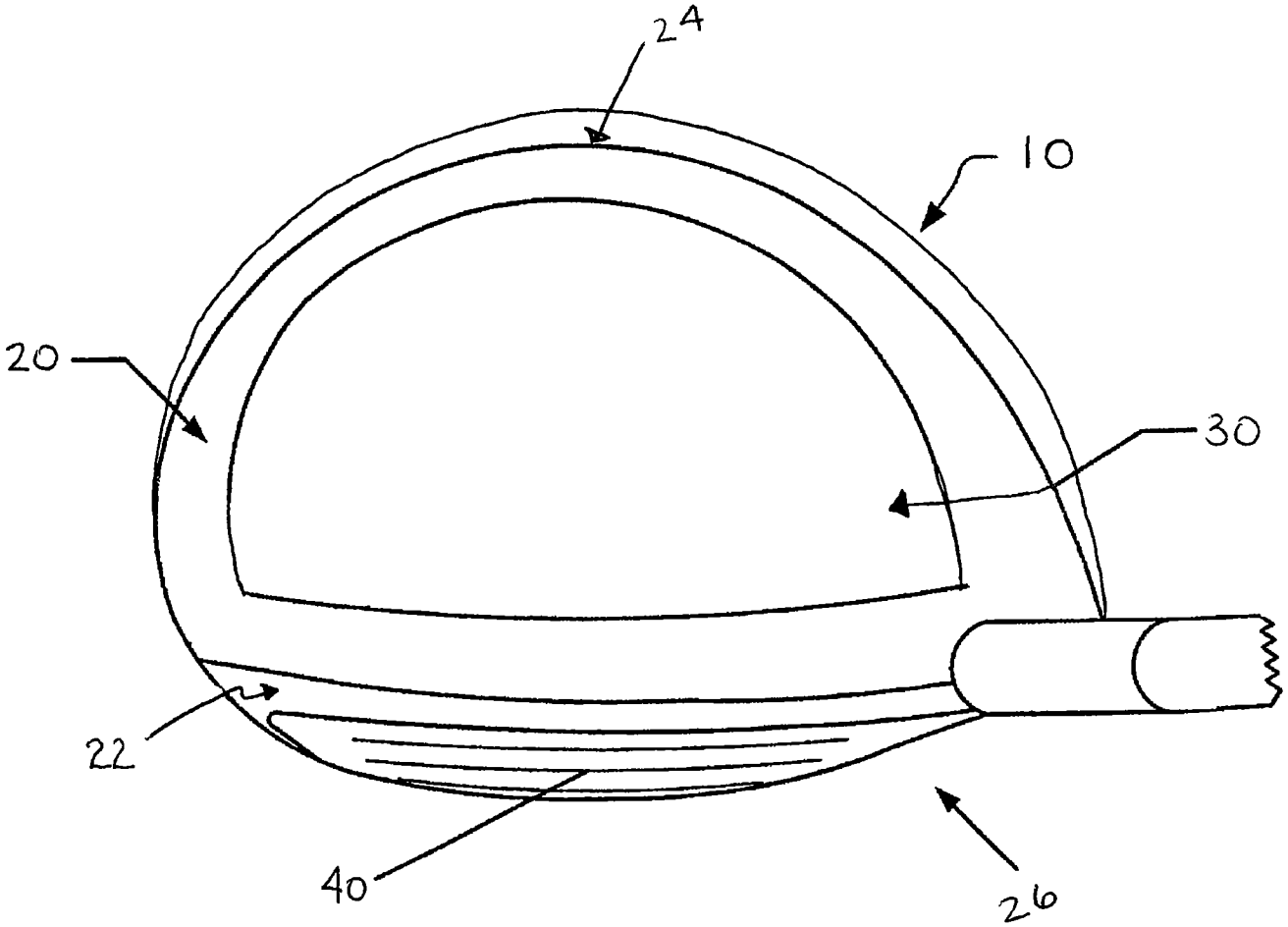
FIG. 2 shows a top view of one embodiment of a golf club head according to the present invention.

FIG. 1 shows a portion of a golf club head 10 of the present invention. In the illustrated embodiment, the club head body member 20 is formed from a first low density titanium alloy. The crown 30 is formed form a second low density titanium alloy. The face insert 40 is formed from a third low density titanium alloy. In one embodiment, the club head body member 20 is further separated into components. For example, as shown in FIG. 2, the club head body member 20 has a face 22, a skirt 24, and a sole 26, which are all formed as separate pieces from different titanium alloys. In such an embodiment, the components may be coupled to each other in a variety of manners with welding being one preferred manner. In FIGS. 1 and 2, the hosel and shaft are shown, but not considered to be part of the club head body member.

Figure 3:
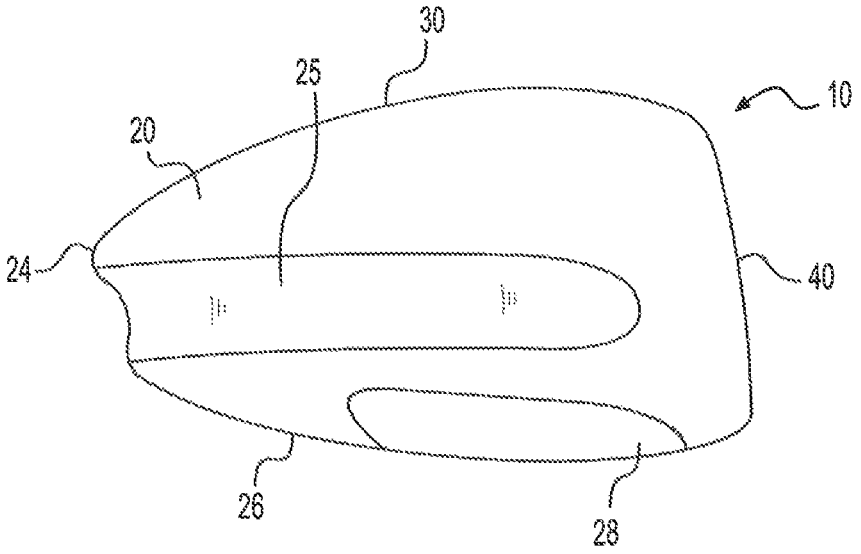
FIG. 3 shows a side view of one embodiment of a golf club head according to the present invention.

FIG. 3 shows another embodiment of the invention where the club head body member 20 is formed from separate components. In particular, the club head body member includes a skirt 24, a skirt portion 25, a sole 26, a sole portion 28, a crown 30, and a face insert 40. In this aspect of the invention, the skirt 24 and sole 26 are formed as part of the club head body member, but the skirt portion 25 and sole portion 28 are formed from titanium alloys that differ from the titanium alloys that are used to form the club head body member 20. The face insert 40 is also formed form a different titanium alloy than the club head body member. The crown 30 may be formed form the same or different titanium alloy than the club head body member.

Figure 4:
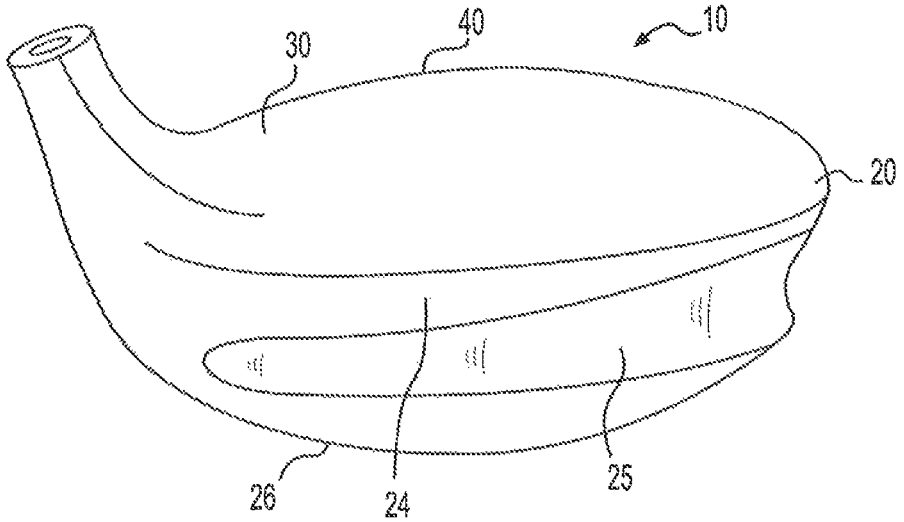
FIG. 4 shows a rear perspective view of one embodiment of a golf club head according to the present invention.

In FIG. 4, a rear view of a club head shows a club head body member 20 that is formed from a first titanium alloy and includes the crown 30 and sole 26. A second titanium alloy is used to form the skirt portion 25 and a third titanium alloy is used to form the face insert 40.

Low Modulus, High Density Alloys for a Multi-Component Club Head

In another aspect of the invention, a club head is formed from low specific modulus materials with densities similar to stainless steel. For example, the density of steel typically varies based on the alloying constituents but usually ranges between about 7.75 g/cm$^3$ and 8.05 g/cm$^3$. While using steel in fairway woods generally provides a desirable mass distribution for the smaller head size, the smaller size of the face makes it difficult to achieve maximum coefficient of restitution when using stainless steel because the face must remain a certain thickness in order not to compromise the durability. However, if titanium alloys are used to make the fairway wood, the lower modulus of the material increases the COR of the club head, but the low density of the titanium alloy requires the use of weights to achieve the desired mass. In the past, manufacturers have attempted to balance the benefits of both materials in fairway woods with the use of a titanium face and a steel body. The present invention provides a solution to the issue with a high strength titanium face and a club head body member formed from titanium or zirconium alloys or both that achieves weight targets in the range of 180 g to 220 g, while still maximizing the internal mass distribution and volume of the club head. In addition, because titanium alloys and zirconium alloys are compatible with titanium and titanium alloys, the joining of the club head body member with the face is facilitated.

Materials

In this aspect of the invention, suitable materials for use in forming the club head body member include, but are not limited to, binary, tertiary, and higher titanium and zirconium alloys such as Ti—Zr, Ti—Hf, Ti—Mo, Ti—V, Ti—Ta, Ti—Nb, Ti—Cr, Zr—W, Zr—Hf, and Zr—Ta. As would be appreciated by one of ordinary skill in the art, zirconium and hafnium may be alloyed with titanium in any proportion while still maintaining a single phase based on their isomorphous nature. Likewise, zirconium is isomorphous with hafnium and, thus, Zr—Hf alloys may be made by melting.

The densities of the titanium and zirconium alloys for use in forming the club head body member (or portions thereof) may range from about 6 g/cm$^3$ to about 9 g/cm$^3$. In one embodiment, the density of the material used to form the golf club head body member (or portions thereof) ranges between about 6.5 g/cm$^3$ and 8 g/cm$^3$. In another embodiment, the density of the material used to form the golf club head body member (or portions thereof) ranges from about 6.75 g/cm$^3$ to about 7.75 g/cm$^3$. Suitable alloys that may be used to achieve such densities include, but are not limited to, Zr-5W, Zr-6Ta, Zr-7Hf, Zr-10Mo, Zr-16Nb, and combinations thereof.

Method of Forming

One method of forming a golf club head according to this aspect of the invention includes a first step of casting a club head body member from a first titanium or zirconium alloy leaving the face open. While the specific embodiments provided below contemplates two and three components, each formed from a different material, one of ordinary skill in the art would appreciate that the present invention extends to embodiments where the club head body member is further separated into multiple components, e.g., a sole, a skirt, and the like, each of which may be formed from different materials.

The first material may have a density ranging from 6.0 g/cm$^3$ to about 9.0 g/cm$^3$. In one embodiment, the density of the first material is about 7.0 g/cm$^3$ to about 8.5 g/cm$^3$. According to one aspect of the invention, the first material has a density of about 7.5 g/cm$^3$ to about 8.1 g/cm$^3$. For example, the density of the first material may be about 7.6 g/cm$^3$ to about 8.05 g/cm$^3$.

In one embodiment, the first material is a binary titanium alloy, such as Ti—Zr, Ti—Hf, Ti—Mo, Ti—Ta, Ti—Nb, Ti—Cr. For example, the first material may be Ti—Hf, Ti—Mo, Ti—Ta, Ti—Nb, and combinations thereof. In another embodiment, the first material may be Ti—Zr, Ti—Cr, and combinations thereof. In yet another embodiment, the first material is a binary zirconium alloy such as Zr—W, Zr—Hf, and Zr—Ta. In this aspect of the invention, the first material may be a binary alloy that is melted from technically pure metals.

In one embodiment, the first material may be a binary titanium-zirconium alloy that includes about 25 percent to about 75 percent by weight zirconium. The density range for these two alloys preferably ranges from about 4.9 g/cm$^3$ to 5.81 g/cm$^3$. In another embodiment, the first material may be a binary titanium-zirconium alloy that includes less than about 25 percent by weight (14.9 atomic percent) but more than 5 percent by weight (2.7 atomic percent) zirconium, resulting in a titanium-rich alloy. For example, the first material may be a binary titanium-zirconium alloy that includes about 10 percent to about 19 percent by weight zirconium. In one embodiment, the first material is a binary titanium-zirconium alloy that includes 13 percent to 17 percent by weight zirconium. In addition to Ti and Zr, may include about 0.09 to about 0.11 percent oxygen and about 0.02 to about 0.03 percent nitrogen.

In yet another embodiment, the first material is a higher titanium-rich alloy that comprises Ti—Zr-6Al-4V.

The thickness of the club head body member may be from about 0.1 mm to about 1.0 mm. In one embodiment, the thickness of the club head body member is about 0.2 mm to about 0.8 mm. In still another embodiment, the thickness of the club head body member is about 0.4 mm to about 0.6 mm. In yet another embodiment, the thickness of the club head body member is about 0.5 mm.

After the club head body member is cast, one embodiment contemplates cutting out the crown so that a different material may be used for the crown. In this aspect of the invention, the crown may be stamped out from a second material that is different from the first material but has a similar density range. For example, the second material may be a high density material ranging from 6.0 g/cm$^3$ to about 9.0 g/cm$^3$. In one embodiment, the density of the second material is about 7.0 g/cm$^3$ to about 8.5 g/cm$^3$. According to one aspect of the invention, the second material has a density of about 7.5 g/cm$^3$ to about 8.1 g/cm$^3$. For example, the density of the second material may be about 7.6 g/cm$^3$ to about 8.05 g/cm$^3$. In one embodiment, the second material is any one of the alloys described above with regard to the first material.

The thickness of the crown may be from about 0.1 mm to about 1.0 mm. In one embodiment, the thickness of the crown is about 0.2 mm to about 0.8 mm. In still another embodiment, the thickness of the crown is about 0.4 mm to about 0.6 mm. In yet another embodiment, the thickness of the crown is about 0.5 mm.

In another embodiment of the invention, co-forging may be used to form the high density materials, e.g., the first and second materials, for the club head body member and optional crown. For example, a titanium bar may be drilled and inserted with a higher density material (such as steel). Any suitable method of inserting the higher density material is within the scope of the invention, but press fitting is preferred. Once inserted, the hole is welded shut and the bar is forged into the desired shape. The high density material will flow with the titanium such that components formed using this method will have the modulus slightly higher than titanium, but densities ranging from about 6.0 g/cm$^3$ to about 9.0 g/cm$^3$, preferably about 7.0 g/cm$^3$ to about 8.5 g/cm$^3$, more preferably about 7.5 g/cm$^3$ to about 8.1 g/cm$^3$, and even more preferably about 7.6 g/cm$^3$ to about 8.05 g/cm$^3$. The components formed in this manner can be welded together to form a club head.

In one embodiment, the face is formed from a third material that has a density lower than the density of the first (and second) material used to form the club head body member. The face may be formed from wrought sheet by stamping or stamping and machining. The third material may have a density ranging from 3.5 g/cm$^3$ to about 5.5 g/cm$^3$. In one embodiment, the density of the third material is about 4.0 g/cm$^3$ to about 5.5 g/cm$^3$. According to one aspect of the invention, the third material has a density of about 4.1 g/cm$^3$ to about 5.1 g/cm$^3$. In one embodiment, the third material has a density at least about 30 percent less than the density of the first (and second) material. In another embodiment, the third material has a density at least about 35 percent less than the density of the first (and second) material. In still another embodiment, the third material has a density at least about 40 percent less than the density of the first (and second) material.

In one embodiment, the third material is selected from the group consisting of Ti-6-4, SP-700, Ti-5111, and TCX11. In another embodiment, the third material is selected from the group consisting of Ti-15-3-3-3, Beta C, DAT 51, and DAT 55. In yet another embodiment, the face insert is formed from two or more components, each component formed from a different material selected from the group consisting of Ti-6-4, SP-700, Ti-15-3-3-3, Beta C, DAT 51, and DAT 55.

The thickness of the face insert is less than about 1.0 mm. In one embodiment, the face insert is less than about 0.8 mm. In another embodiment, the face insert is about 0.6 mm or less. In still another embodiment, the face insert is about 0.5 mm or less.

The face insert (and crown if separate from the club head body member) may be joined together with the club head body member (in the respective cavities) via welding, diffusion brazing, roll bonding, diffusion bonding, liquid interface diffusion (LID) bonding, or combinations thereof. In one embodiment, the face (and crown) insert may be joined to the club head body member via welding. The type of welding used to join each insert to the club head body member may be the same for both inserts or different. As would be appreciated by those of ordinary skill in the art, the type of welding used to join the components together may be any suitable welding that results in a joined product with the least weld material at the joints and heat affected zones. In this aspect, suitable types of welding for use with the present invention include, but are not limited to, laser welding, plasma welding, TIG welding, MIG welding, or combinations thereof. In one embodiment, the type of welding used to join either or both of the crown and face components may be laser welding, plasma welding, or combinations thereof. Without being bound to any specific theory, laser and plasma welding reduces the amount of material added at the joint and result in smaller heat affected zones (as compared to TIG welding).

In another embodiment, the face insert may be joined with the club head body member using roll bonding, diffusion bonding, diffusion brazing, LID bonding, or combinations thereof. If additional components are used, such as a skirt and a sole that are separate from the club head body member, these components may be stamped or machined into the desired shape and welded to the club head body member using any suitable welding method as described above.

Figure 5:
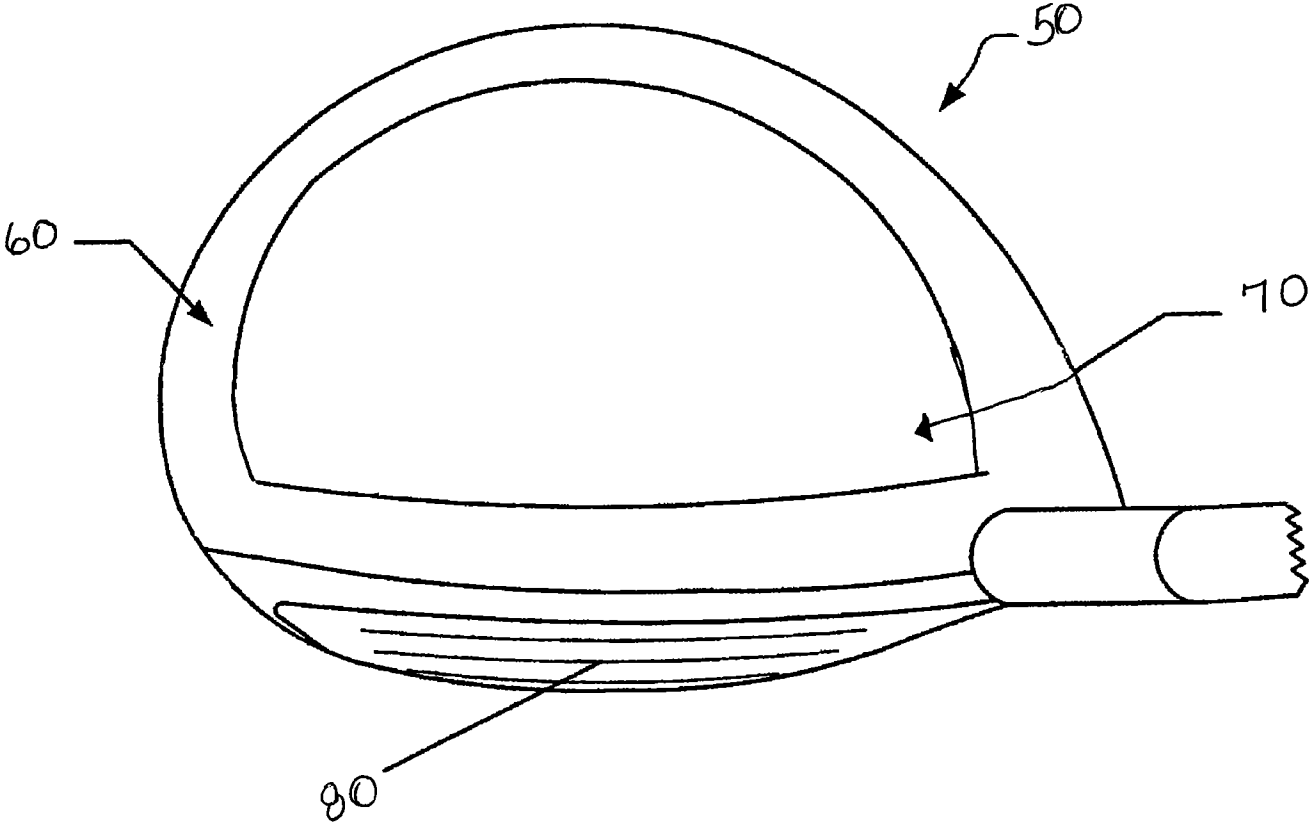
FIG. 5 shows a top view of one embodiment of a golf club head according to the present invention.

FIG. 5 shows a portion of a golf club head 50 of the present invention. In the illustrated embodiment, the club head body member 60 is formed from a first material having a density ranging from about 6.0 g/cm$^3$ to about 9.0 g/cm$^3$. The crown 70 may be formed in a unitary fashion with the club head body member 60. In the alternative, the crown 70 may be formed separately from the club head body member 60 and from a second material that can be the same or different from the club head body member 60. The face insert 80 is formed from a third material and, more specifically, a low density titanium alloy. In one embodiment, the club head body member 60 is further separated into components, e.g., a skirt and a sole, that are formed as separate pieces from the same or different materials from each other and the main portion of the club head body member 60. different titanium alloys. In FIG. 5, the hosel and shaft are shown, but not considered to be part of the club head body member.

The golf club constructions described above may be employed in a wood-type golf club. For a metal wood such as a driver or a fairway wood, the club head has a volume of about 100 cc to about 460 cc. Preferably, the volume of a metal wood club head is at least about 250 cc. According to one aspect of the invention, the volume for a hybrid club is between about 100 cc and about 200 cc. In one embodiment, the volume for a hybrid club is between about 125 cc and 150 cc. In one embodiment, the volume of a hybrid club according to the present invention may be less than 130 cc.

Finishing touches, e.g., painting and sanding, may optionally be performed for aesthetic purposes.

Although the present invention has been described with reference to particular embodiments, it will be understood to those skilled in the art that the invention is capable of a variety of alternative embodiments within the spirit of the appended claims. For example, golf club heads in accordance with examples of this invention may include still additional features, if desired, including features that are known and used in the art. For example, a golf club head according to the invention may include a weighting system that is permanently mounted to the club head body member, e.g., on an interior or exterior of the club head body, extending from the exterior to the interior of the club head body (e.g., through a weight port), etc., or, in the alternative, a weighting system that includes weight member(s) that are movably and/or removably mounted with respect to the club head body member using structures and techniques that are known and used in the art (e.g., by screw or other mechanical connector attachments, by sliding attachments, etc.). Alternately, the sole may include one or more cavities that are capable of accommodating inserts having variable weights. In addition, golf clubs according to the invention may include one or more of: (a) a shaft member engaged with the club head body; (b) a grip member engaged with the shaft, and/or (c) a handle member engaged with the club head and/or the shaft. These additional elements of the golf club structure may be included in the overall club structure in any desired manner without departing from this invention, including in conventional manners that are known and used in the art (e.g., the shaft may be engaged with the club head body member via an external hosel member, via an internal hosel member, through an opening provided in the club head, via adhesives, and/or via mechanical connectors.

The invention claimed is:

1. A golf club head, comprising: a first portion comprising a body defining an inner volume, sole, and a skirt, wherein the first portion is formed from a first titanium alloy having a first density ranging from about 4 g/cm$^3$ to about 5 g/cm$^3$; a second portion comprising a crown, wherein the second portion is formed from a second titanium alloy having a second density ranging from about 4 g/cm$^3$ to about 5 g/cm$^3$; and a third portion comprising a face, wherein the third portion is formed from a third titanium alloy having a third density ranging from about 4 g/cm$^3$ to about 5 g/cm$^3$.

2. The golf club head of claim 1, wherein the second density is different from the first density.

3. The golf club head of claim 1, wherein the first titanium alloy comprises Ti-8Al-1V-1Mo.

4. The golf club head of claim 1, wherein the second titanium alloy comprises Ti-5Al-1Fe-1Cr-0.7Mo.

5. The golf club head of claim 1, wherein the third density is greater than the first and second densities.

6. The golf club head of claim 1, further comprising a weight.

* * * * *